United States Patent [19]

Ahlm

[11] 4,357,725

[45] Nov. 9, 1982

[54] BODY-SUPPORT DEVICES

[75] Inventor: Lars G. W. Ahlm, Fjärås, Sweden

[73] Assignee: AB Wilh. Becker, Stockholm, Sweden

[21] Appl. No.: 108,169

[22] Filed: Dec. 28, 1979

[30] Foreign Application Priority Data

Oct. 1, 1979 [SE] Sweden ..... 7900237

[51] Int. Cl.[3] ..... A47C 27/15

[52] U.S. Cl. ..... 5/468; 5/473; 5/481; 428/71; 428/314.4; 428/316.6

[58] Field of Search ..... 5/481, 468, 473, 420; 297/DIG. 1; 428/71, 314.4, 316.6

[56] References Cited

U.S. PATENT DOCUMENTS

| | | | |
|---|---|---|---|
| 1,843,893 | 2/1932 | Becher | 297/DIG. 1 |
| 2,616,486 | 11/1952 | Hawley, Jr. et al. | 5/481 |
| 3,187,069 | 6/1965 | Pincus et al. | 5/481 X |
| 3,210,781 | 10/1965 | Pollock | 5/481 X |
| 3,248,738 | 5/1966 | Morgan | 5/481 X |
| 3,327,333 | 6/1967 | Jessup | 5/481 |
| 3,518,786 | 7/1970 | Holtvoigt | 5/481 X |
| 3,833,259 | 9/1974 | Pershing | 5/481 X |
| 4,092,752 | 6/1978 | Dougan | 5/481 X |
| 4,147,825 | 4/1979 | Talalay | 5/481 X |

FOREIGN PATENT DOCUMENTS

| | | |
|---|---|---|
| 1685192 | 9/1970 | Fed. Rep. of Germany . |
| 1427619 | 3/1976 | United Kingdom . |

*Primary Examiner*—Alexander Grosz
*Attorney, Agent, or Firm*—Browdy and Neimark

[57] ABSTRACT

A body-support device for use as a mattress or cushion for hospital beds comprises an inner core (10) of soft, resilient plastics material having predominantly open cells, said core having two mutually opposite major surfaces (10*a*,10*b*) connected together by side surfaces (10*c*). Each major surface (10*a*,10*b*) is covered with a thin layer (11,12) of soft, resilient plastics material having predominantly closed cells, said thin layers (11,12) also covering at least two side surfaces of said inner core. The surfaces of the thin layers (11,12) remote from the core (10) are covered with a plastics foil (14,15). The uncovered side surfaces of the inner core serve to enable air to pass into and out of the inner core. The plastics foil provides the body-support device with a surface which can readily be kept clean. The thin layers (11,12) afford a better and stronger bonding of the plastics foil to the body-support device.

9 Claims, 1 Drawing Figure

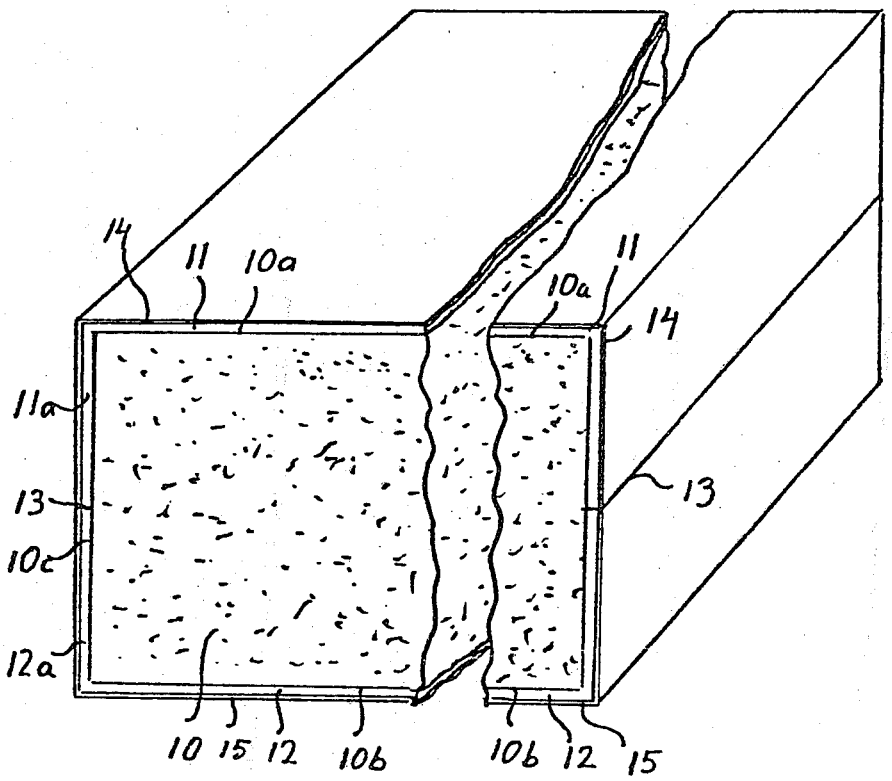
14
11
10a
11
10a
14
11a
13
13
10c
12a
10
15
12
10b
10b
12
15

BODY-SUPPORT DEVICES

The present invention relates to body-support devices for use as mattresses or cushions, comprising an inner core of soft, resilient plastics material with predominantly open cells. The body-support devices according to the invention are primarily intended for use in hospitals, nursing homes, old peoples' homes and like institutions.

It is previously known to produce mattresses, cushions and the like from foamed rubber or foamed plastics. Such mattresses and cushions, however, are difficult to clean and to keep clean. This is particularly true when using such mattresses and cushions on hospital beds. This disadvantage has hitherto been overcome by providing the mattresses and cushions with differing forms of loose covers, such as mattress-covers, bed-sheets, underlays, rubber-sheets etc. etc. The large number of removable covers used, however, has made cleaning complicated and has rendered the daily making of beds difficult.

The main object of the present invention is to provide a comfortable and pleasant body-support device such as a mattress, or cushion, which can be readily cleaned and disinfected, so that the number of loose covers required can be considerably reduced, whereby cleaning work and work involving the normal making of beds can be considerably cut-down while obtaining considerable improvements from the aspect of hygiene, and which is also relatively inexpensive to manufacture.

With this object the invention provides a body-support device for use as a mattress or cushion, comprising a relatively thick inner core made of a soft, resilient plastics material with predominantly open cells and having two, mutually opposite major surfaces and a plurality of side surfaces extending therebetween, a first covering of a relatively thin layer of a soft, resilient plastics material with predominantly closed cells bonded to said major surfaces and at least two of said side surfaces, and a second covering of thin plastics foil bonded to said first covering of material of predominantly closed cellular structure, at least one side surface being in direct contact with the ambient air.

By using an inner core of soft, resilient plastics material having predominantly open cells, i.e. mutually communicating cells, there is obtained a soft support which readily and quickly conforms to the contours of a person resting thereupon. In order for the body-support device, e.g. the mattress or cushion, to rapidly conform to the contours of said person, however, it is necessary that air can be exchanged between the cells of the plastics core and the ambient atmosphere without hinder. Accordingly, at least one side surface of the inner core is in direct contact with the ambient air, to permit air to enter and to leave the inner core. This communication can be effected by either leaving at least one side surface at least partially uncovered, or by covering all said side surfaces and perforating the coverings on at least one side surface. The thin layer of plastics material with closed cells and the plastics foil applied thereon can conveniently be omitted on the short sides of the mattress, since these sides are the least likely to be dirtied. With the exception of the short sides, the mattress is then fully enclosed by the protective thin layer of plastics material with closed cells and the plastics foil. As the thin layers of plastics foil applied thereon are tightly joined along the long side surfaces of the mattress, the risk of dirtying the mattress at these joints is eliminated. Particular advantage is obtained when the joints between the thin layers and plastics foils covering the two major surfaces of the core are placed substantially along the longitudinal centre line of the long sides of the inner core, since movements in the core are slight at this location, irrespective of which side of the mattress faces upwards. By arranging the air-exchange opening or openings of the mattress on the short sides thereof, it is possible to arrange said opening or openings so that full symmetry is obtained with respect to the horizontal centre plane of the mattress, whereby the properties of the mattress remain totally unaffected by which side of the mattress faces upwards.

The plastics foil, which has a very smooth surface, greatly facilitates cleaning of the mattress surfaces, since contaminants and bacteria are unable to cling to the surface. The arrangement of a thin plastics layer having predominantly closed cells between the surface of the inner core and the plastics foil provides a much stronger bond between the foil and the core than would otherwise have been possible if the plastics foil was applied directly to the core. Since the core comprises a plastics material having communicating cells, movement of a person resting on the mattress can give rise to local pockets of high air-pressure acting on the foil from beneath, such that said foil tends to loosen from the core. The thin layer of plastics material having predominantly closed cells, which layer has a porous surface structure, can readily take up any large, local pockets of high air pressure from beneath, without the risk of the layer loosening from the inner core. Because some of the cells in the thin layer are open cells, which is the case even though the cells are predominantly closed cells, there is also obtained a certain reduction in pressure and consequently a decrease in the stresses and strains at the transition surface between the inner core and the thin layer. There is no risk of the plastics foil loosening from the thin layer when a load is placed on the mattress, since the thin layer has predominantly closed cells, and hence no local pockets of high air pressure can occur between the thin layer and the plastics foil. A further advantage afforded by the intermediate thin layer, which conveniently comprises a polyester foamed plastics, is that said layer hardens immediately and can therefore be more readily bonded to the inner core by flame lamination than can a plastics foil.

An exemplary embodiment of the invention will now be described in more detail with reference to the accompanying drawing, the single FIGURE of which is a perspective of view of a mattress, partly broken away.

The mattress illustrated in FIG. 1 comprises a comparatively thick inner core 10 of soft, resilient plastics material having predominantly open cells, i.e. mutually communicating cells. A suitable plastics material in this respect is foamed polyether, which is a relatively inexpensive material having a density of about 35 kg/m$^3$. The illustrated inner core 10 has a parallelepipedic form with two mutually opposing major surfaces 10*a*,10*b* having a size of 2000×900 mm. Suitably the core has a thickness of 100 mm. Each major surface 10*a*,10*b* is covered with a thin layer 11,12 of soft, resilient plastics material having predominantly closed cells, i.e. cells which do not communicate with one another, bonded to the surface of the core. A suitable material in this respect is foamed polyester, and the layer suitably has a thickness of 0.5–3 mm. The thin layers 11,12 of the illustrated embodiment extend over the edges of the core 10 at the long sides thereof and over the side surface 10*c* of the core and are bonded to said side surface 10*c*. The folded edge parts 11*a*,12*a* of the layers 11,12 extend into abutment with each other and form a sealed joint 13 substantially along the longitudinal centre line of the side surface 10*c*. The thin layers are in the illustrated embodiment bonded to the major surfaces of the core by flame laminating techniques and to the side surfaces of the core by low-frequency welding techniques. The thin layers 11,12 are covered with a plastics foil 14,15, which may have a thickness of 0.01–1.0 mm and is bonded to the thin layers 11,12. A suitable material for this purpose is polyurethane film. The plastics foil is flame laminated onto the thin layers, this suitably being effected before said thin layers are bonded to the core 10. In order to provide for communication between the inner core and the ambient atmosphere, the short side surfaces of the illustrated core are left uncovered. Alternately, the short side surfaces may be covered with the thin, closed-cell layers and the foil layer, and the said layers perforated at said short side surfaces, so that an exchange of air can take place between the communicating cells of the core 10 and the surrounding atmosphere. Free air-exchange is essential for the good functioning of the mattress. If this exchange of air is prevented, the mattress will resemble an air mattress or inflatable mattress, which is far less comfortable.

Although only one long side and one short side of the described mattress have been fully illustrated in the figure, it will be understood that the other long side and short side of said mattress are constructed in the same manner as the illustrated sides. Thus, the illustrated and described mattress is symmetrical about a horizontal centre plane through said mattress, and consequently the mattress can be turned without changing its properties in any respect.

Although only one embodiment of the invention has been illustrated and described, it will be understood that modifications can be made within the scope of the following claims. Thus, the cushion or mattress can be given any suitable form, and it is not necessary for the mutually opposite major surfaces of the core 10 to be parallel. If it is not really necessary for the mattress or cushion to be turned, said mattress or cushion need not be symmetrical with respect to a horizontal centre plane, thereby affording greater freedom in the positioning of joints and air-exhange openings. Many other plastics materials than those referred to with respect to the illustrated embodiment may be used. The different layers may be bonded to each other by using other methods than flame lamination and low-frequency welding, e.g. by gluing.

I claim:

1. A bed mattress or cushion, comprising a relatively thick core made of a soft, resilient plastics material with predominantly open cells and having a substantially parallelepipedic shape with two, substantially rectangular, mutually opposite major surfaces and two longside surfaces and two shortside surfaces extending between said major surfaces, said major surfaces and said longside surfaces of said core being covered with a relatively thin layer of a soft, resilient plastics material with predominantly closed cells bonded to said major surfaces and said longside surfaces of said core, said relatively thin layer of a soft, resilient plastics material being covered with a thin, substantially impermeable, plastics foil bonded to said thin layer of a soft, resilient plastics material with predominantly closed cells, and said shortside surfaces of said core being exposed to the ambient air.

2. A bed mattress or cushion as claimed in claim 1, wherein said relatively thin layer of a soft, resilient plastics material with predominantly closed cells and the thin plastics foil bonded thereto are made up of a first section of a relatively thin layer of soft, resilient plastics material with predominantly closed cells and a thin plastics foil bonded thereto extending uninterrupted over one major surface and substantially one adjacent half part of the two longside surfaces of said core, and a second section of a relatively thin layer of a soft, resilient plastics material with predominantly closed cells and a thin plastics foil bonded thereto extending uninterrupted over the opposite major surface and the remaining half parts of the two longside surfaces of the core, the edges of said first and second sections of the thin layer of soft, resilient plastics material with predominantly closed cells and thin plastics foil bonded thereto being joined to each other substantially along the longitudinal center lines of the longside surfaces of the core.

3. A bed mattress or cushion as claimed in claim 1, wherein said plastics foil is flame-laminated on said thin layer of soft, resilient plastics material with predominantly closed cells.

4. A bed mattress or cushion as claimed in claim 1, wherein said thin layer of a soft, resilient plastics material with predominantly closed cells is flame-laminated on the major surfaces of said core.

5. A bed mattress or cushion as claimed in claim 4, wherein said thin layer of a soft, resilient plastics material with predominantly closed cells is bonded to the longside surfaces of said core by electric low-frequency welding.

6. A bed mattress or cushion as claimed in claim 4, wherein said thin layer of soft, resilient plastics material with predominantly closed cells is bonded to said longside surfaces of said core by means of an adhesive.

7. A bed mattress or cushion as claimed in claim 1, wherein said core comprises foamed polyether.

8. A bed mattress or cushion as claimed in claim 1, wherein said thin layer of soft, resilient plastics material comprises foamed polyester.

9. A bed mattress or cushion as claimed in claim 1, wherein said thin plastics foil comprises polyurethane film.

* * * * *